US005172081A

United States Patent [19]

Gabriel et al.

[11] Patent Number: 5,172,081

[45] Date of Patent: Dec. 15, 1992

[54] POLARIZER ARRANGEMENT

[75] Inventors: Timothy A. Gabriel; David G. Spencer, both of Lincoln, United Kingdom

[73] Assignee: Plessey Semiconductors Limited, Swindon, England

[21] Appl. No.: 681,694

[22] Filed: Apr. 8, 1991

[30] Foreign Application Priority Data

Apr. 9, 1990 [GB] United Kingdom ..... 9008033
Feb. 12, 1991 [GB] United Kingdom ..... 9102938

[51] Int. Cl.[5] ..... H01P 1/16
[52] U.S. Cl. ..... 333/21 A; 343/756
[58] Field of Search ..... 333/21 A, 24.3; 343/756

[56] References Cited

U.S. PATENT DOCUMENTS 3,166,724 1/1965 Allen ..... 333/24.1
3,216,017 11/1965 Moore ..... 343/756
3,419,822 12/1968 Andre et al. ..... 333/24.3 X
3,626,335 12/1971 Hord et al. ..... 333/21 A X
3,938,158 2/1976 Birch et al. ..... 333/21 A X
4,195,270 3/1980 Rainwater ..... 333/21 A
4,806,945 2/1989 Cormier et al. ..... 343/756

FOREIGN PATENT DOCUMENTS 361672 4/1990 European Pat. Off. .
1067895 10/1959 Fed. Rep. of Germany .
1085934 7/1960 Fed. Rep. of Germany .
01339 2/1986 PCT Int'l Appl. .
814921 6/1959 United Kingdom .
818447 8/1959 United Kingdom .
891427 3/1962 United Kingdom .

*Primary Examiner*—Paul Gensler
*Attorney, Agent, or Firm*—Spencer, Frank & Schneider

[57] ABSTRACT

A polarizer arrangement in accordance with the invention includes a circular depolarizer combined in a common component with a linear polarizer. The depolarizer material includes a recess within which a ferrite rod is located, a bias coil being wound around the polarizer and the rod. In another arrangement, a polyrod waveguide feed is also included in the component, being integrated with the circular depolarizer and the linear polarizer.

13 Claims, 1 Drawing Sheet

POLARIZER ARRANGEMENT

BACKGROUND OF THE INVENTION

This invention relates to polariser arrangements and more particularly, but not exclusively, to arrangements which are suitable for the reception of both linearly and circularly polarised waves.

In a receiving system, for example for receiving a signal from a satellite, after the signal has been received at a dish reflector, it is transmitted along a waveguide to a detector. A polariser is included in the waveguide between the receiving dish and the detector to ensure that only signals with the correct polarisation are transmitted along the waveguide.

In one type of polariser, a ferrite rod is located in the waveguide and is surrounded by a bias coil around the waveguide. It acts as a linear polariser to transmit either vertically or horizontally polarised waves, the mode of polarisation selected being controlled by applying current of an appropriate magnitude and polarity to the bias coil.

The present invention arose from an attempt to provide a compact polariser arrangement which may be fabricated at low cost and which is particularly suitable for use with equipment for receiving satellite signals.

SUMMARY OF THE INVENTION

According to the invention, there is provided a polariser arrangement comprising a linear polariser integrated with a circular depolariser, at least part of the polariser and depolariser forming portions of a common polariser-depolariser component. A circular depolariser is a waveguide component which transforms or translates linearly polarised waveforms into circularly polarised waveforms and visa versa. It is used to convert circularly polarised signals, which may be right or left hand polarised, into linear polarised signals. A linear polariser is a waveguide component which can separate and select either of the two orthogonal linearly polarised signal waveforms propagated within an orthogonally symmetrical waveguide. It is used to select either vertically or horizontally polarised signals for transmission along a waveguide.

Preferably, the circular depolariser is a dielectric member which tapers along its length to present a wedge or vane configuration to incoming signals. The part of the wedge or vane of smallest cross-sectional area is arranged to be at the front of the reception path of the signals. It is preferred that the dielectric member is tapered in only one dimension such that its width decreases along its length. This gives a configuration which may be readily fabricated. The decrease in width may be at a uniform rate to give planar surfaces but the member preferably has curved surfaces.

Preferably, the linear polariser includes a ferrite rod surrounded by a bias coil.

In a particularly advantageous embodiment of the invention, the polariser-depolariser component includes an aperture within which the ferrite rod of the linear polariser is located. Advantageously, the bias coil of the linear polariser is wound on the polariser portion. By positioning the coil within the waveguide, the efficiency and sensitivity of the bias current per degree of Faraday rotation may be arranged to be very large.

Preferably, in use, the ferrite rod is arranged to be collinear with a longitudinal axis of a waveguide, which is typically orthogonally symmetrical.

In a further advantageous embodiment of the invention, the common component of the combined linear polariser and circular depolariser also includes a polyrod waveguide feed which preferably at least partly projects from the end of the waveguide. The waveguide feed focuses incoming received radiation for reception and transmission along the waveguide and is formed from a synthetic material in a generally cylindrical configuration, hence the term "polyrod" is usually used when referring to this type of feed.

BRIEF DESCRIPTION OF THE DRAWINGS

Some ways in which the invention may be performed are now described by way of example with reference to the accompanying drawings, in which.

DESCRIPTION OF THE PREFERRED EMBODIMENTS

Figure 1B:
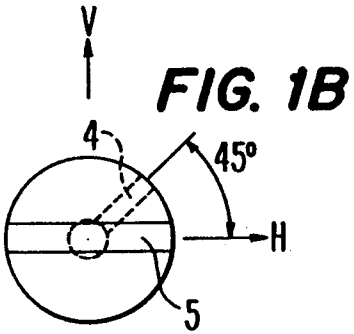
FIGS. 1A and 1B schematically illustrate a polariser arrangement in accordance with the invention.
Figure 1A:
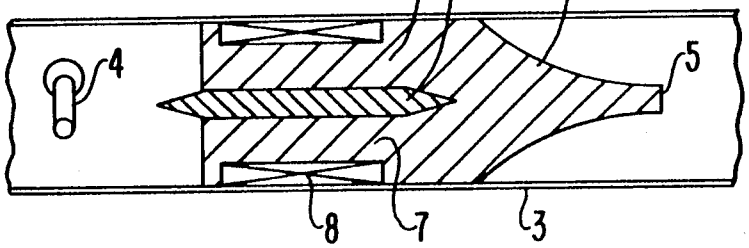

With reference to FIGS. 1A and 1B, a polariser arrangement comprising a combined circular depolariser 1 and linear ferrite polariser 2 is arranged in a waveguide 3 which is orthogonally symmetric, being in this case of circular cross-section. Incoming radiation is transmitted along the waveguide 3 in the direction shown by the arrow and, after being transmitted by the depolariser 1 and polariser 2 is received by an E plane probe 4.

The circular depolariser 1 comprises a dielectric wedge which tapers along the waveguide, being narrowest at its end 5 nearest the front of the polariser arrangement. The circular depolariser 1 extends across the waveguide 3 in the horizontal direction, as shown in FIG. 1B, and the E Plane probe is arranged at 45° to the horizontal and vertical directions. The dielectric material of the circular depolariser 1 extends along the waveguide 3 and includes a recess in which a ferrite rod 6 is located along the axis of the waveguide 3. The material includes a portion of reduced width 7 which acts as a former around which the bias coil 8 of the linear polariser 2 is wound.

The polariser arrangement shown is a universal one which enables both linear and circularly polarised waves to be received, the mode selected depending on the current through the bias coil 8.

Figure 2:
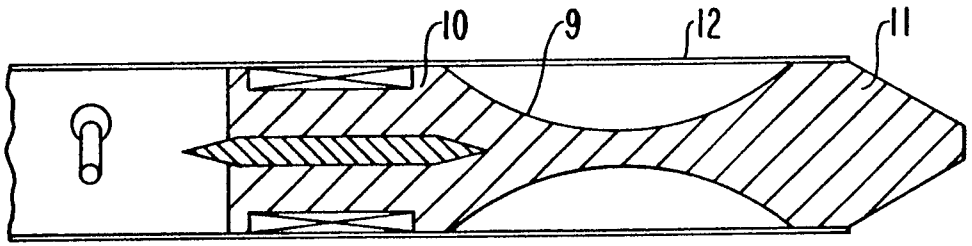
FIG. 2 schematically illustrates another arrangement in accordance with the invention in which a waveguide feed is integrated with the polariser arrangement.

With reference to FIG. 2, another polariser arrangement is similar to that illustrated in FIG. 1A having a circular depolariser 9 integrated with linear ferrite polariser 10. However, in this arrangement, the arrangement also includes a polyrod waveguide feed 11 which extends from the end of the circular waveguide 12. The waveguide feed 11 is of the same material as the circular depolariser 9 and is fabricated at the same time as the remainder of the polariser arrangement to give an integrated sub-assembly which is relatively compact and readily fabricated.

We claim:

1. A polariser arrangement for receiving both linearly and circularly polarised signals, comprising a polariser-depolariser component formed of a dielectric material including a linear polariser portion; and a circular depolariser portion integrated with said linear polariser portion, said circular depolariser portion being tapered along its length in only one dimension, the part of said circular depolariser portion of smallest cross-sectional area receiving said signals, said linear polariser portion of said polariser-depolariser component separating and selecting orthogonal components of received linearly polarised signals, and the circular depolariser portion thereof transforming received linearly polarised signals into circularly polarised signals and visa versa.

2. An arrangement as claimed in claim 1 wherein the linear polariser portion of said polariser-depolariser component includes a ferrite rod, and wherein said arrangement further comprises a bias coil surrounding said ferrite rod.

3. An arrangement as claimed in claim 2 wherein, when the arrangement is used within a waveguide having a longitudinal axis, the ferrite rod is collinear with the longitudinal axis of the waveguide.

4. An arrangement as claimed in claim 3 wherein said polariser-depolariser component includes an aperture within which said ferrite rod is located.

5. An arrangement as claimed in claim 3 wherein said bias coil is wound on the polariser portion of said polariser-depolariser component.

6. An arrangement as claimed in claim 2 wherein said polariser-depolariser component includes an aperture within which said ferrite rod is located.

7. An arrangement as claimed in claim 6 wherein said bias coil is wound on the polariser portion of said polariser-depolariser component.

8. An arrangement as claimed in claim 2 wherein said bias coil is wound on the polariser portion of said polariser-depolariser component.

9. An arrangement as claimed in claim 8 wherein the polariser portion of said polariser-depolariser component includes a region of reduced width where the bias coil is wound.

10. An arrangment as claimed in claim 1 wherein the polariser-depolariser component includes a polyrod waveguide feed.

11. An arrangement as claimed in claim 10 wherein, when the arrangement is used within a waveguide, the waveguide feed extends at least partly from the end of the waveguide.

12. A polariser arrangement for receiving both linearly and circularly polarised signals, comprising a polariser-depolariser component formed of a dielectric material including a linear polariser portion; and a circular depolariser portion integrated with said linear polariser portion, said circular depolariser portion being tapered along its length in only one dimension, the part of said circular depolariser portion of smallest cross-sectional area receiving said signals, said linear polariser portion of said polariser-depolariser component separating and selecting orthogonal components of received linearly polarised signals, and the circular depolariser portion thereof transforming received linearly polarised signals into circularly polarised signals and visa versa;

a ferrite rod positioned within an aperture in the linear polariser portion of said polariser-depolariser component; and a bias coil surrounding said ferrite rod.

13. A polariser arrangement for insertion in a waveguide having a longitudinal axis and first and second orthogonal directions perpendicular to said longitudinal axis, said arrangement receiving both linearly and circularly polarised signals, comprising a polariser-depolariser component formed of a dielectric material positioned within said waveguide, said polariser-depolariser arrangement including a linear polariser portion; and a circular depolariser portion integrated with said linear polariser portion having an end for receiving said signals, said circular depolariser portion having a dimension in the first direction of said waveguide which decreases along said longitudinal axis from said linear polariser portion to the end thereof, the end of said depolariser extending substantially across the waveguide in said second direction, said linear polariser portion of said polariser-depolariser component separating and selecting orthogonal components of received linearly polarised signals, and the circular depolariser portion thereof transforming received linearly polarised signals into circularly polarised signals and visa versa;

a ferrite rod positioned along the longitudinal axis of said waveguide within an aperture in the linear polariser portion of said polariser-depolariser component; and a bias coil surrounding said ferrite rod, said bias coil being interposed between said waveguide and said polariser-depolariser component.

* * * * *